US005487287A

United States Patent [19]

Viggiano

[11] Patent Number: 5,487,287

[45] Date of Patent: Jan. 30, 1996

[54] QUICK-RELEASE LOCK RETAINING BRACKET METHOD AND APPARATUS

[76] Inventor: Mark S. Viggiano, 5225 Fidge Pl. NE., Tacoma, Wash. 98422

[21] Appl. No.: 116,005

[22] Filed: Sep. 2, 1993

[51] Int. Cl.[6] ..... E05B 9/08; E05B 65/46

[52] U.S. Cl. ..... 70/86; 70/370; 70/371; 70/466

[58] Field of Search ..... 70/367–371, 370, 70/466, 451, 85–88

[56] References Cited

U.S. PATENT DOCUMENTS

| | | | |
|---|---|---|---|
| 713,245 | 11/1902 | Roche | 70/370 |
| 1,606,864 | 11/1926 | Aldeen | 70/370 |
| 2,101,812 | 12/1937 | Kistner | 70/370 |
| 2,610,500 | 9/1952 | Poupitch | 70/370 |
| 2,745,275 | 5/1956 | Jacobi | 70/370 |
| 3,434,316 | 3/1969 | Neary | 70/368 |
| 3,863,471 | 2/1975 | Keller-Volper | 70/370 X |

FOREIGN PATENT DOCUMENTS

| | | | |
|---|---|---|---|
| 613854 | 1/1961 | Canada | 70/370 |
| 67305 | 7/1948 | Denmark | 70/370 |
| 0390669 | 10/1990 | European Pat. Off. | 70/370 |
| 994868 | 11/1951 | France | 70/370 |
| 879217 | 6/1953 | Germany | 70/370 |
| 11892 | of 1902 | United Kingdom | 70/370 |

*Primary Examiner*—Lloyd A. Gall

*Attorney, Agent, or Firm*—Christensen O'Connor Johnson & Kindness

[57] ABSTRACT

A quick release lock retaining bracket facilitates the quick removal, replacement, or transfer of an entire locking mechanism from one restricted access chamber such as a drawer or cabinet to any other such chamber, therein permitting a rapid shift of exclusive personal control of any restricted access chamber to a designated person. The retaining bracket includes a receiving plate fastened to the inside of the access front panel of a drawer, cabinet, or the like. The receiving plate is centered over a hole normally provided for the cylinder portion of a key-type lock, and is formed with portions thereof removed to receive the lock housing in a way that permits the housing to rest against the inside surface. In this way, a person can slide or advance the lock forward through the receiving plate to the inside surface which acts as a fence or backstop for the lock mechanism to rest upon, the lock being held in its final operating position. Once a lock is guided into position it is maintained in position by a retaining latch pivotally mounted to the receiving plate. The retaining latch pivots from an open position that permits the lock to be advanced into operating position, to a locked position in which a lock so advanced is maintained in its operating position, between the drawer and the retaining latch.

5 Claims, 4 Drawing Sheets

QUICK-RELEASE LOCK RETAINING BRACKET METHOD AND APPARATUS

BACKGROUND OF THE INVENTION

This invention relates generally to key operated cabinet-type locks, and more particularly to a novel retaining bracket therefor. This invention further relates to a method of retaining and securing cabinet-type locks to cabinet drawers or doors, and the like.

In financial institutions and various other businesses, there exists a need to protect and secure money, documents, and other valuable items. For this purpose, it is common for such businesses to provide restricted access chambers such as drawers and cabinets. Access to these chambers is frequently restricted and controlled by key operated cabinet-type locks mounted on the front access panels of the drawers or cabinets. In this way, businesses can limit access to drawers and the like to only those designated employees that have a specific key to a specific lock.

For a number of reasons these businesses, at some time, have to change or remove locks, or take other measures to ensure the integrity of restricted access chambers. For example, in the banking industry, it is quite common for a bank or its branch locations to employ part-time tellers that work irregular shifts, at various work stations within a branch. In fact, it is common for a number of part-time tellers to work together at one office or branch. Standard operating procedures that banks typically follow usually require that each teller have a personalized lock-operated cash drawer that is exclusively controlled by the teller against entry by others. For this reason, key control to drawers and integrity thereof is critical. Consequently, because part-time employees frequently change work station locations, or because banks sometimes experience employee turnover, banks must take steps to ensure the integrity of the locks.

Moreover, permanent bank employees must sometimes shift location to any one of multiple work stations within a branch or home office. Accordingly, teller-line equipment that includes locked drawers must be flexible to permit regular personnel reassignments among the various cash drawers throughout an office, without sacrificing the integrity and security of the locks. As one might perceive, maintaining the integrity of locks under these circumstances is difficult at best.

More specifically, when keys are duplicated or shared between employees, the integrity of such restricted access chambers is compromised. Accordingly, some measure of key control is usually required. One way to control the circulation of keys is for a bank to provide a key to a specific lock only to the person who is intended to have exclusive control over a predetermined restricted access chamber. In this way, an employee is motivated to preserve the integrity of the chamber by ensuring that duplicate keys are limited and stay within the employee's control. However, this method of key control greatly limits the ability of a business to shift exclusive control of a restricted access chamber from one employee to another while maintaining confidence that duplicate keys do not exist.

Over the years, banks and other financial institutions have addressed the problem of exclusive control in different ways. For example, with cash drawers, some banks solve this problem by installing multiple locks on the access or closure panels thereof. The locks are positioned side by side, one lock for each teller who is to have exclusive control over the drawer. In this way, any one person who controls one of the locks, can also individually and exclusively control the cash drawer. However, this solution is inadequate because the number of employees or tellers having their own designated lock in any one drawer is limited to the number of locks that can physically be installed.

A number of other arrangements and inventions have been created to maintain the integrity of locked restricted access chambers. Most are directed to methods of removing an entire lock mechanism or parts thereof so that locked drawers and the like can be re-keyed thereby enabling businesses to maintain exclusive control over such restricted access chambers.

One of the early designs, disclosed in U.S. Pat. No. 210,807 to Sargent, is directed to a key operated locking mechanism that is mounted in a predetermined recess formed in the face of a drawer. This design, however, is limited. First, the design requires that a portion of the mounting surface be removed to receive the lock thereby adding to the expense of its installation as well as permanently modifying the mounting surface. Also, because the lock is attached to the drawer surface with screws, changing the entire lock mechanism requires tools and is therefore slow and somewhat cumbersome.

A subsequent design shown in U.S. Pat. No. 3,824,817 to Orr, discloses a lock mechanism having a key receiving "cylinder" portion, a housing that fits into a recess in the mounting surface, and a retainer spring. When repair, replacement, or modification of the lock is required, the lock cylinder portion can be separated and removed from the lock housing. Thus, when a user requires a lock to operate with new or different keys, the cylinder portion of the lock mechanism must be removed and replaced. With this design, however, a special tool is required for such removal or replacement of the cylinder. Because of this, lock repair or modification is somewhat awkward, and depends on the availability of the tool. Further, like Sargent, a portion of the mounting surface must be permanently modified for the positioning of the lock in the drawer.

More recently, U.S. Pat. No. 4,099,397 to Dauenbaugh was issued disclosing a lock mechanism comprising a sleeve having a removable cylinder mechanism contained therein. Installation requires the sleeve to be fitted in a hole provided in a drawer's access panel. A retainer member secures the cylinder mechanism into operating position. Replacement of the cylinder mechanism is accomplished by removing the same from the sleeve. Although special tools are not necessarily required, the mechanism must be broken down into several components when a cylinder is removed. Thus when the lock is being re-keyed, or repaired, parts could be lost or misplaced. Moreover, the procedure for reassembly is sufficiently complicated that the user must possess a certain level of skill.

Finally, U.S. Pat. No. 4,873,852 was issued to Neyret disclosing a fixation fork for a cylinder lock plug to retain such locks primarily in automobile doors. The Neyret fixation fork operates by exerting a force on the lock mechanism to bias the same against the door of an automobile. Like Orr, however, a special tool is required for fork removal to access the lock mechanism. Also, the procedure for lock removal requires a series of oscillating movements which makes the procedure slow and tedious.

As seen from the above, banks and other institutions are limited in ways currently available to ensure and maintain the integrity of restricted access chambers. The various lock installation arrangements noted above are primarily directed to semi-permanent installation of whole lock assemblies or parts thereof. None suggest or teach a way to quickly and easily re-key restricted access chambers. Likewise, none suggest or teach a satisfactory method to enable businesses and employees alike to maintain exclusive control over locked drawers and cabinets when part-time and permanent employees are shifted among work stations. Accordingly, there exists a need for a quick and simple way for banks and other businesses to maintain exclusive control over locked restricted access chambers.

SUMMARY OF THE INVENTION

One object of the invention is to help businesses maintain the integrity of locked restricted access chambers including drawers, cabinets, cash boxes, and teller lines.

A second object of the invention is to facilitate a bank's employment of part-time tellers while maintaining the integrity of locked restricted access chambers.

Another object is to facilitate quick and easy replacement of locks to restricted access chambers in banks and other financial institutions.

Still another object is to allow several employees to share one drawer or cabinet, and have exclusive control thereover without having to share keys.

A further object is to readily shift control of restricted access chambers such as drawers and cabinets from one employee to another while maintaining the integrity of such chambers.

Yet another object is to enable bank tellers to freely move among cash drawers and to exert exclusive personal control thereover.

Still another object is to eliminate a bank's need to install multiple permanent locks on cash drawers.

Yet another object is to minimize disruption of banking services that occur when keys to the locks of cash drawers are lost.

A still further object of the invention is to enable a bank to change the locks on drawers and cabinets alike without the use of tools.

The invention is a quick release lock retaining bracket for use in financial institutions or the like wherein the bracket facilitates quick removal, replacement, or transfer of an employee's entire personally assigned locking mechanism which he or she retains while employed and then, during his or her specific working hours, he or she quickly installs the personal locking mechanism, with the support of the quick release retaining bracket, on an access panel of a restricted access chamber such as a bank tellers cash drawer. By use of the bracket of the present invention, the employee can quickly assume exclusive control of any drawer or cabinet. The quick release retaining bracket includes a receiving member attached to an access panel of a restricted access chamber such as the exterior front panel of a drawer, the receiving member having a portion thereof removed to form an opening to receive a lock mechanism. Once the lock is so received, a retaining latch, pivotally mounted to the receiving member, is pivoted to a position blocking the lock's removal. The retaining latch is movable from a first open position to permit a lock to be so received, to a second closed position in which a lock so received is retained into operating position between an access panel and the retaining latch.

In accordance with another aspect of the invention, a method is disclosed for retaining a lock mechanism to a mounting surface such as a bank teller's cash drawer. The method accommodates quick removal or installation of the lock mechanism without the use of tools, thereby enabling a person to quickly assume or relinquish exclusive control of the drawer. The method includes attaching a receiving member to a mounting surface for receiving a lock, wherein a retaining latch is rotatably mounted to the receiving member. The latch being movable from a first open position to permit the lock to be so received, to a second locked position in which the body of a lock so received is retained into its operating position between the mounting surface and the retaining latch.

In accordance with another aspect of the invention, a quick release retaining bracket comprises a receiving member mounted on a drawer, the drawer having an opening sized to receive a lock. A lock so received is retained into position by a retaining member that slides into position to block the lock's removal. The retaining latch is slideable from a first open position to permit a lock to be so received, to a second closed position in which a lock so received is retained into operating position between an access panel and the retaining latch.

An advantage of the invention is the reduced cost of relocking teller lines and cash drawers.

A further advantage is to reduce or eliminate a business's need to periodically employ the services of a locksmith.

The foregoing and additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF PREFERRED EMBODIMENT

FIGS. 1 through 4 illustrate a preferred embodiment of a quick release lock retaining bracket 18 in accordance with the present invention.

Figure 1:
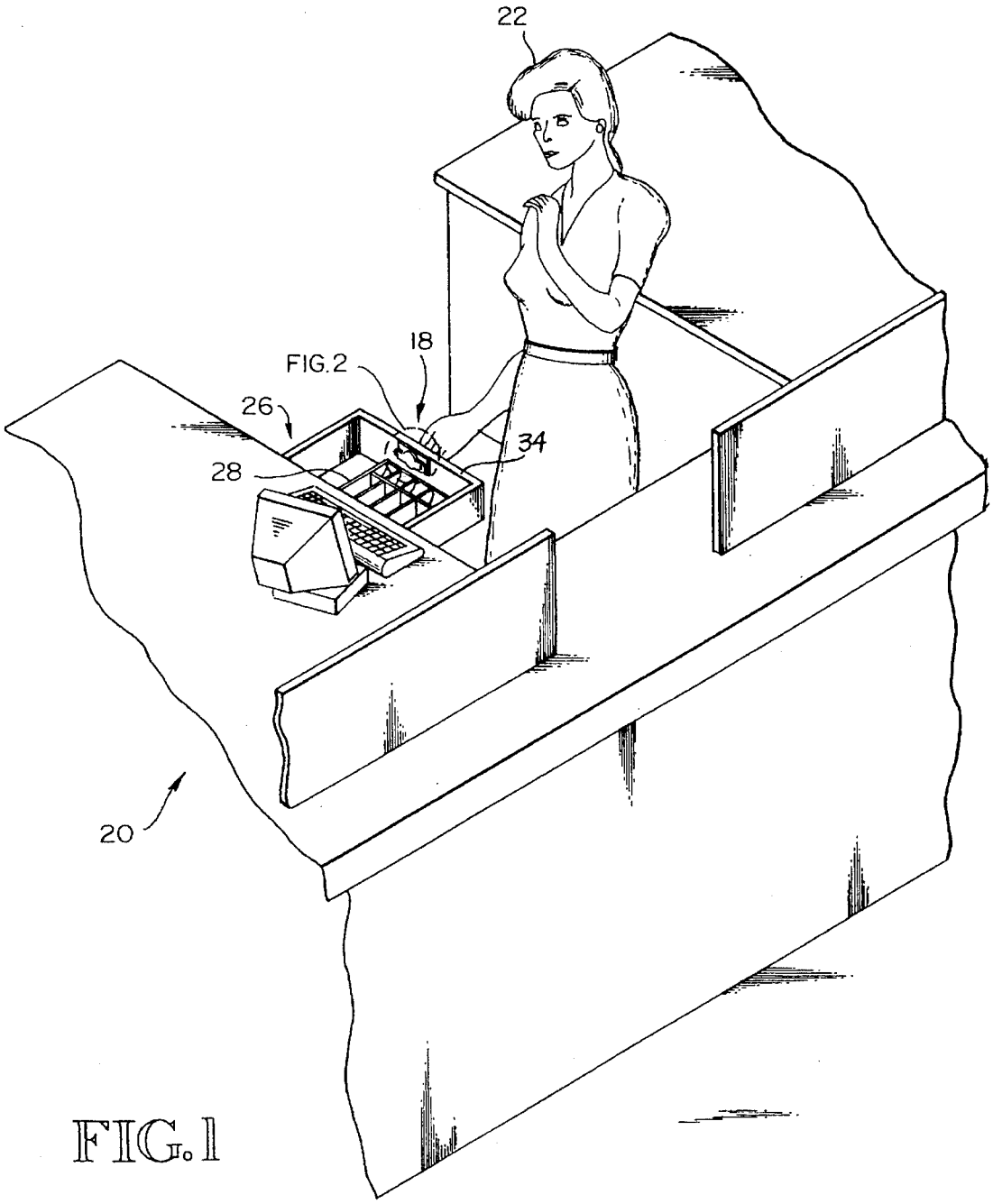
FIG. 1 is a perspective view of a bank teller work station arrangement illustrating a teller operating the lock on a personally controlled cash drawer that encloses a cash box, wherein the lock on the drawer is held in position by a quick release retainer bracket in accordance with the present invention.

A general arrangement for a teller work station 20 is illustrated in FIG. 1. Included therein is a bank teller 22 operating a lock mechanism for a restricted access chamber 26, which in this example is a drawer. The restricted access chamber 26 is personally and exclusively controlled by the teller 22, and is shown with a cash box 28 enclosed therein. The lock mechanism is mounted in the access or closure part 34 of the restricted access chamber 26 and is held in position by the quick release retainer bracket 18 of the present invention.

Figure 2:
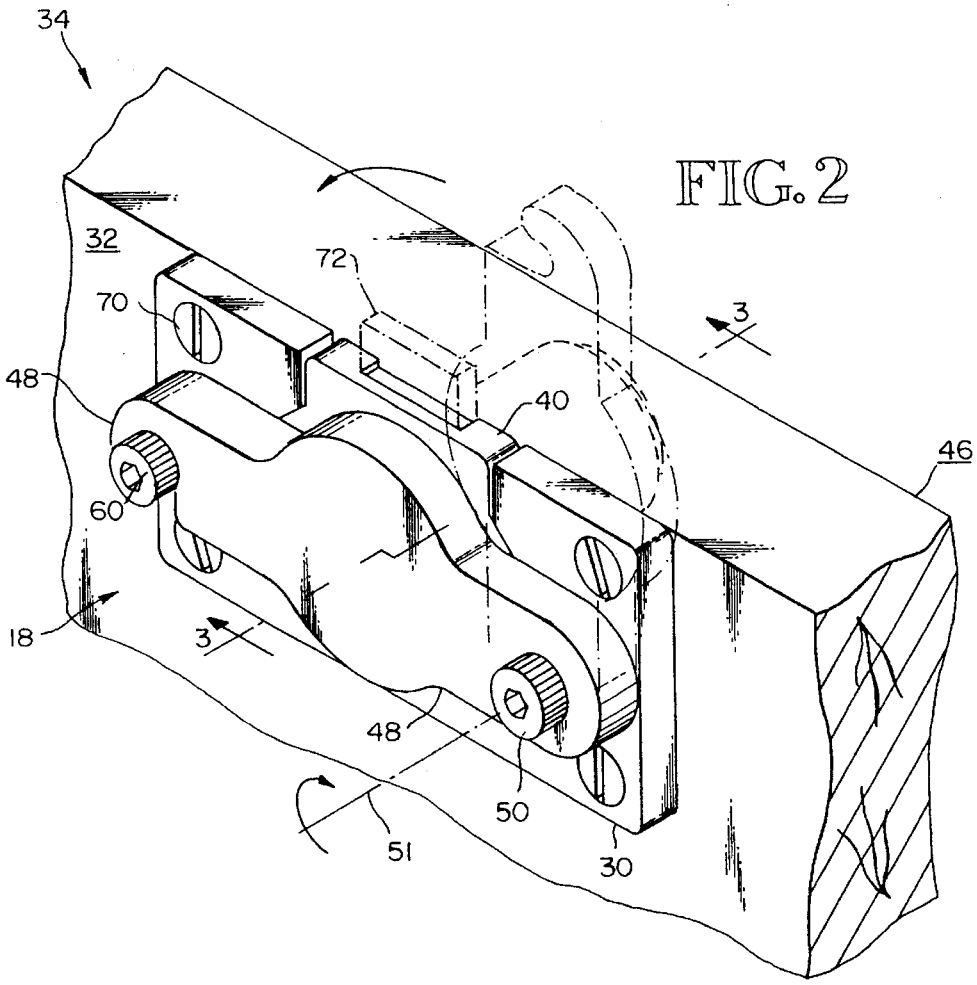
FIG. 2 is a perspective view illustrating a quick release retainer bracket in accordance with the present invention securing and retaining an installed lock mechanism to an interior surface of a restricted access chamber with the retaining latch in the second, closed position, along with phantom lines indicating a retaining latch in the first open position, and a locking post in the locked position.
Figure 3:
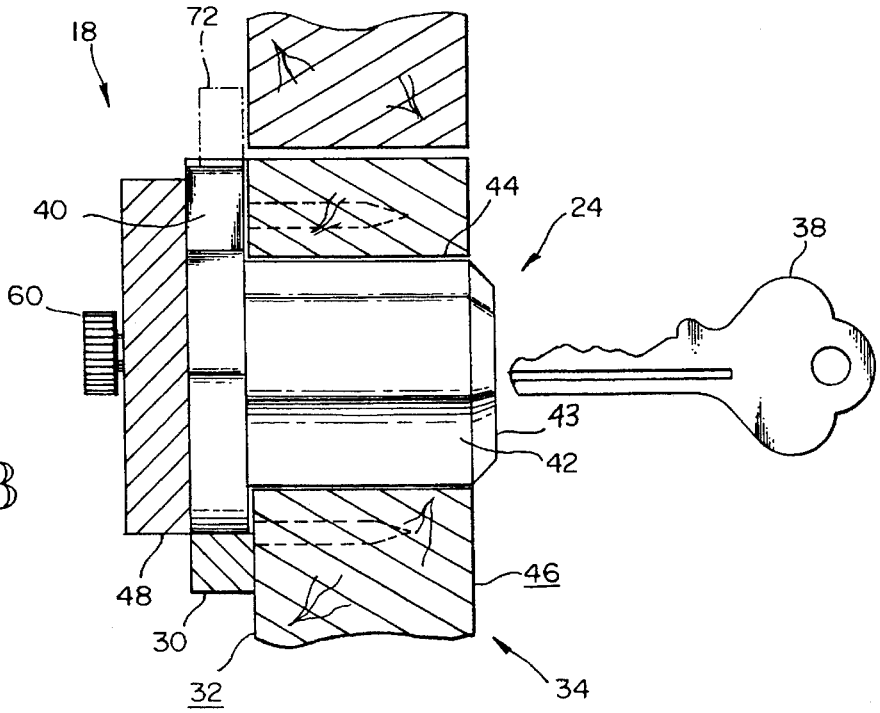
FIG. 3 is a cross-sectional view taken along line 3—3 illustrating an installed lock mechanism with phantom lines showing a locking post in the locked position.
Figure 4:
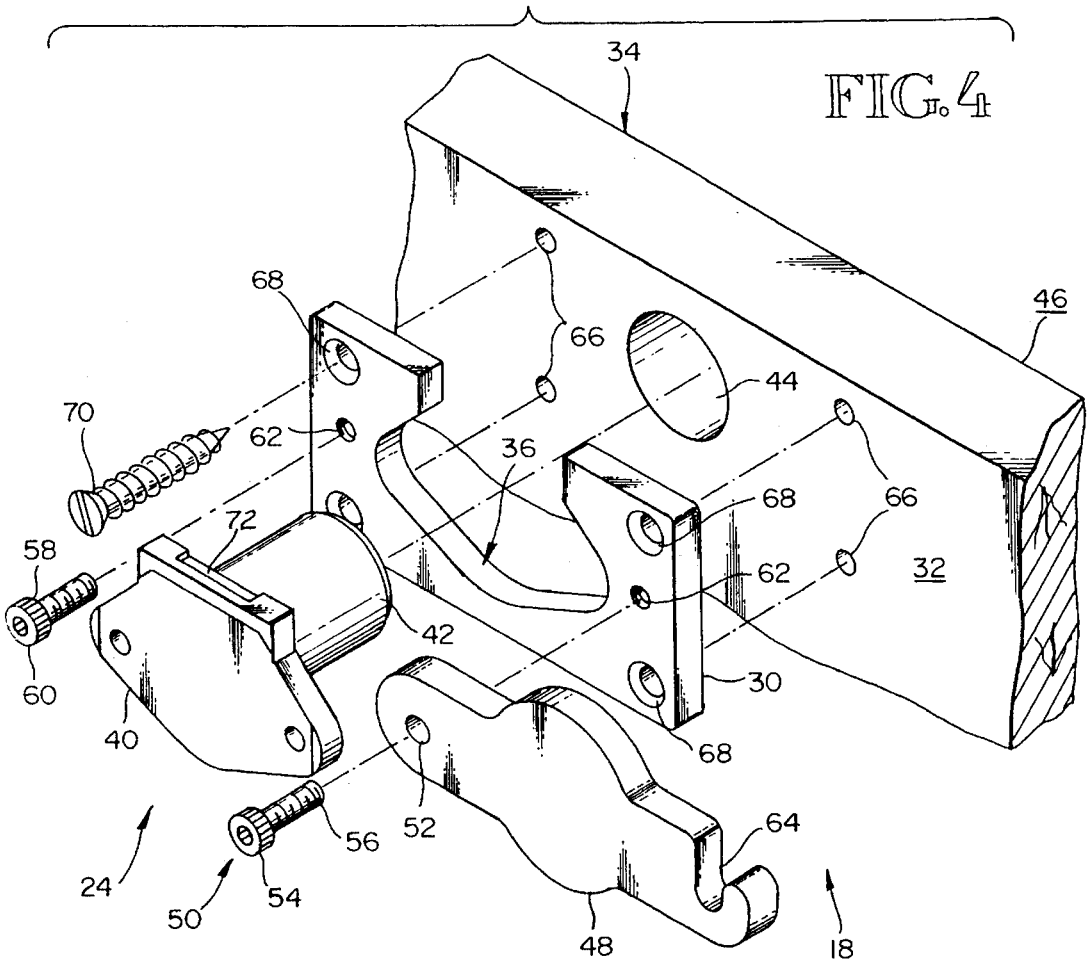
FIG. 4 is an exploded perspective view of a lock arranged to be moved into operating position into the receiving channel of the receiving member of a quick release lock bracket.

Attention is directed to FIGS. 2–4 for a more detailed description of the quick release lock retaining bracket 18 and related structures. In the preferred embodiment, a quick release lock retaining bracket 18 includes a receiving member 30 that is attached to the interior surface 32 of the access panel 34 of the restricted access chamber 26, which in this example is the drawer in a teller's work station 20 typically found in a bank. As best seen in FIG. 4, the receiving member 30 has portions thereof removed to form a central receiving channel 36. The receiving channel 36 is an opening formed to match the foot print or shape of the rear flange or housing 40 of a lock mechanism 24. As shown in the preferred embodiment, the channel 36 has an open sidewall. The receiving channel 36 is so formed to receive the lock mechanism housing 40 in a close fitting relation to prevent the lock mechanism from twisting when the lock is operated by a key 38 (shown in FIG. 3). The lock mechanism housing is so received when advanced forward by linear translation toward the exterior face 46, of the access panel 34 into its operating position as illustrated in FIGS. 2–3.

Lock mechanism 24 typically includes the rear housing 40 and a smaller cylinder 42 that extends outward therefrom. When the lock mechanism 24 is in its operating position, the housing 40 is disposed in the receiving channel 36 of the receiving member 30. The cylinder 42 extends through a lock-receiving recess or hole 44 provided through the access panel 34. The hole 44 extends from an interior surface 32 to an exterior surface 46 of the access panel 34. As best seen in FIG. 3, the lock housing 40 is larger than the cylinder 42 to limit the extent to which the lock can be slid forward. When fully inserted, the outer key face 43 of the cylinder 42 is exposed at the exterior of the access panel. In this way, access to the lock mechanism 24 is provided from outside the restricted access chamber 26.

To secure lock mechanism 24 in its operating position, and to enable quick release thereof from the restricted access chamber 26, a retaining latch 48 is provided. The retaining latch 48 is an elongate component pivotally mounted to the receiving member 30 and is moveable from a first open position as illustrated by phantom lines in FIG. 2, to a second closed position as shown by solid lines in the same FIG. 2. In this way, lock mechanism 24 can be advanced forward into the receiving channel 36, into its operating position, while the retaining latch 48 is in the open position, until the lock housing 40 engages the interior surface 32 of the access panel 34. Then, to maintain the lock mechanism 24 in its operating retained position, the retaining latch 48 is moved to the second closed position, blocking removal of the lock mechanism 24 by forming an abutment behind the rear face of the lock mechanism. Accordingly, the lock housing 40 is disposed between the exterior access panel 34 and the retaining latch 48 when the retaining latch 48 is in the closed position therein maintaining the lock mechanism 24 in the operating retained position.

Considering now in more detail the components of the lock retaining bracket 18, the retaining latch 48 is pivotally attached to the receiving member 30 by a pivot pin 50 that extends through a bore 52 disposed through one end of the retaining latch 48. Thus the retaining latch is rotatably mounted to the pivot pin 50. The retaining latch 48 therein being pivotable about a pivot axis 51 extending normal to the interior surface 32 of an exterior access panel 34. In the preferred embodiment, the pivot pin 50 includes a head 54 disposed on a threaded shaft 56. The head 54 so disposed thereon provides a shoulder 58 which, as will be seen, provides a surface that engages the retaining latch 48.

A threaded bore 62 is provided in the receiving member 30 to one side of the receiving channel 36. The threaded bore 62 is so provided to enable the pivot pin 50 to threadably engage the receiving member 30 thereby pivotally attaching the retaining latch 48 to the receiving member 30.

As noted above, the lock mechanism 24 is retained in its forward operating position by the retaining latch 48 disposed in the second closed position. The retaining latch 48 is maintained in the second closed position by a threaded stop pin 60 which, in the preferred embodiment, is identical to the pivot pin 50. Likewise, the stop pin 60 threadably engages a threaded bore 62 disposed through the receiving member 30, to one side of the receiving channel 36, opposite the pivot pin 50.

The stop pin 60 is so disposed to maintain the retaining latch 48 in the second closed position therein precluding further pivoting action. Further, the shoulder 58 of the threaded stop pin 60 is urged against the retaining latch 48 when the stop pin 60 is rotated. This provides friction between the retaining latch 48 and the receiving member 30 thereby maintaining the retaining latch in the closed position. Thus the retaining latch 48 pivots from a first open position to a second closed position where the pivot action is terminated by the stop pin 60. As noted above, the retaining latch 48 pivots about an axis normal to the interior surface 32 of the exterior panel 34. This arrangement, however could be modified to have the retaining latch 48 pivot to the second closed position about some other axis, for example a vertical axis (not shown).

The retaining latch 48 further includes an indentation provided to form a stop notch 64. The stop notch 64 is disposed to engage the stop pin 60 when the retaining latch 48 is moved to the second closed position. A stop notch 64 so provided yields a surface upon which the shoulder 58 of the head 54 can be tightened, thereby urging the retaining latch 48 against the receiving member 30. More specifically, the stop pin 60 is rotatable from an outward position when the retaining latch is moved from the open position to the closed position, to an inward position, closer to the receiving member 30, when the retaining latch 48 is so closed. The stop pin 60 is so rotated to cause the head to engage the retaining latch 48 thereby urging the retaining latch 48 against the receiving member 30. This action produces friction between the retaining latch 48 and the receiving member 30 therein preventing relative movement there between, and thus preventing the retaining latch 48 from moving to the first open position.

Turning again to FIG. 2, the assembled quick release lock retaining bracket 18 is illustrated being attached to the interior surface 32 of a wood exterior access panel 34. It is attached by a plurality of common wood screws 70 that fit through countersunk bores 68 disposed through the receiving member 30 into predetermined screw holes 66 (seen in FIG. 4). However, if the exterior access panel 34 was made from metal, an appropriate fastener could be employed.

Figure 5:
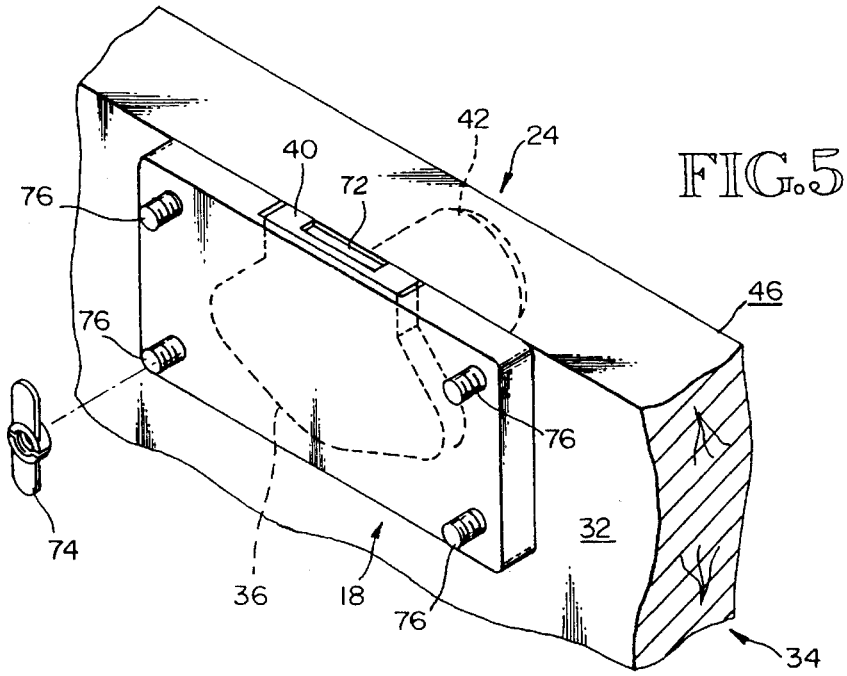
FIG. 5 is a perspective view showing an alternate embodiment.

Finally, an alternate embodiment is illustrated in FIG. 5 disclosing a one piece retaining bracket 18 having a portion thereof removed to form the receiving channel 36. As illustrated, the housing of a lock mechanism is disposed between the retaining bracket 18 and the exterior access panel 34. When the lock is in operating position, the retaining bracket is urged against the exterior access panel 34 by a plurality of wing nuts 74 fastened upon threaded posts 76 which are in turn attached to the exterior access panel 34.

Figure 6:
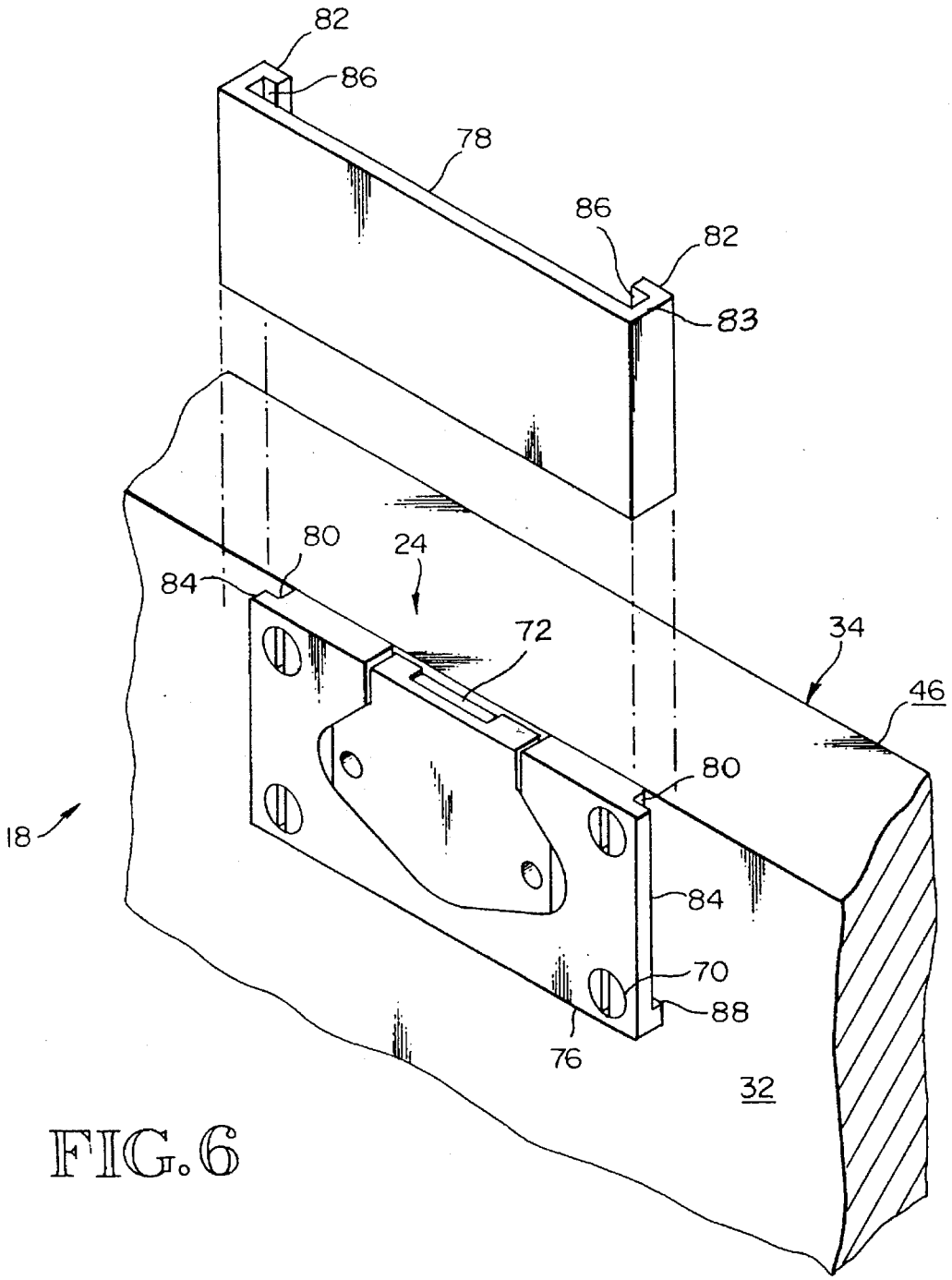
FIG. 6 is a perspective view showing a modification of the preferred embodiment wherein the retaining member slides from an open position to a closed position therein retaining the lock mechanism in operating position.

A further modification of the preferred embodiment, illustrated in FIG. 6, comprises a quick release retaining bracket having a receiving member 76 disposed on the exterior access panel 34 of a restricted access chamber 26. The receiving member 76 is constructed to receive a lock mechanism 24 into its final operating position. Also provided is a retaining latch 78 constructed to slidingly engage the receiving member 76. The retaining member 78 is movable from a first open position to permit a lock to be so received, to a second closed position in which the lock housing so received is retained into operating position between an exterior access panel 34 and the retaining latch 78. In this embodiment, the sliding retaining latch 78 could be adapted to slide in either a horizontal or vertical direction to the second closed position therein retaining the lock mechanism 24 in its final operating position.

Also, as illustrated in FIG. 6, the receiving member 76 comprises a pair of opposing, generally parallel lips 84 disposed to provide a means or surface for the retaining latch 78 to slidingly engage. As illustrated, the lips 84 extend outward from the receiving member 76 therein forming a groove 80. Accordingly, the retaining latch 78 comprises a pair of opposing, generally parallel tracks 86 disposed to slidingly engage the lips 84 of the receiving member 76. The tracks 86 are an extension of the receiving member formed by fingers 83 extending therefrom. When the retaining latch 78 is moved to the second closed position, a base 88 is provided to support the retaining latch in the closed position therein retaining the lock mechanism 24 in operating position.

As seen from the above, a quick release lock retaining bracket 18 is provided to facilitate a persons quick removal, replacement, or transfer of an entire locking mechanism from one restricted access chamber 26 such as a drawer or cabinet to any other such chamber, therein permitting a rapid shift of exclusive personal control of any restricted access chamber 26 to a designated person. When the lock mechanism is disposed in its operating position, a locking post 72 is extended from the lock housing 40 to prevent movement of the exterior access panel.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. In a restricted access chamber having an access panel and a lock mountable on the access panel, the lock having a front key face, a rear flange portion having a rear face and a cylinder extending from the rear flange portion to the front key face, the cylinder being of smaller cross section than the rear flange portion such that the rear flange portion projects outward beyond the periphery of the cylinder, the access panel having an interior surface, an exterior surface, and a recess between the interior and exterior surfaces for closely receiving the lock cylinder, the lock cylinder being insertable into the recess by linear translation from the interior surface toward the exterior surface but insertion of the lock cylinder into the recess being limited by the rear flange portion of the lock, the improvement comprising a retaining bracket member mounted on the access panel adjacent to the interior surface thereof, said bracket member having a receiving channel aligned with the access panel recess and sized to receive the lock rear flange portion, a latch member movable manually relative to said bracket member between an open position out of registration with the access panel recess to allow insertion of the lock cylinder into the recess and a closed position registered with the access panel recess to form an abutment behind the rear face of the rear flange portion of the lock to block retraction thereof away from the interior surface of the access panel, and retaining means for normally maintaining the latch member in its closed position.

2. In the restricted access chamber defined in claim 1, the latch member being pivotally mounted on the retaining bracket member for swinging between the open position and the closed position about an axis extending substantially perpendicular to the interior surface of the access panel.

3. In the restricted access chamber defined in claim 1, the retaining means including a stop projection on one of the members and a stop notch on the other member sized and positioned to receive the stop projection.

4. In the restricted access chamber defined in claim 1, the latch member being slidably mounted on the bracket member.

5. In the restricted access chamber defined in claim 1, the latch member extending across the access panel recess when in the closed position.

* * * * *

UNITED STATES PATENT AND TRADEMARK OFFICE

CERTIFICATE OF CORRECTION

PATENT NO. : 5,487,287

DATED : January 30, 1996

INVENTOR(S) : M.S. Viggiano

It is certified that error appears in the above-indentified patent and that said Letters Patent is hereby corrected as shown below:

Title page,

| | COLUMN | LINE | |
|---|---|---|---|
| item | [56] | Refs. Cited U.S. Pat Docs | Insert --4,099,397 7/11/1978 R.L. Dauenbaugh 70/371-- |
| item | [56] | Refs. Cited U.S. Pat Docs | Insert --3,824,817 7/23/1974 John L. Orr 70/81-- |
| item | [56] | Refs. Cited U.S. Pat Docs | Insert --4,873,852 10/17/1989 Guy Neyret 70/451-- |
| item | [56] | Refs. Cited U.S. Pat Docs | Insert --210,807 12/10/1878 James Sargent-- |
| item | [76] | Inventor | "Fidge" should read --Ridge-- |
| item | [57] | Abstract | "access front" should read --front access-- |
| | 5 | 11 12 | "part" should read --panel-- |
| | 5 | 34 | "exterior face 46, of the access panel 34" should read --exterior face 34 of the access panel-- |

Signed and Sealed this

Fourth Day of June, 1996

Bruce Lehman

*Attest:*

BRUCE LEHMAN

*Attesting Officer*

*Commissioner of Patents and Trademarks*